US007593679B2

(12) United States Patent
Masubuchi

(10) Patent No.: US 7,593,679 B2
(45) Date of Patent: Sep. 22, 2009

(54) HEAT RECYCLING IMAGE FORMING APPARATUS

(75) Inventor: Fumihito Masubuchi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 125 days.

(21) Appl. No.: 11/083,023

(22) Filed: Mar. 18, 2005

(65) Prior Publication Data

US 2005/0220508 A1 Oct. 6, 2005

(30) Foreign Application Priority Data

Mar. 19, 2004 (JP) ..... 2004-079532

(51) Int. Cl.
*G03G 15/20* (2006.01)

(52) U.S. Cl. ..... 399/329; 399/121; 399/328; 399/335

(58) Field of Classification Search ..... 399/329, 399/121, 302, 303, 328, 335
See application file for complete search history.

(56) References Cited

U.S. PATENT DOCUMENTS

| | | | | |
|---|---|---|---|---|
| 2,884,762 | A * | 5/1959 | Lindenblad | 62/3.3 |
| 5,278,618 | A * | 1/1994 | Mitani et al. | 399/329 |
| 6,787,691 | B2 * | 9/2004 | Fleurial et al. | 136/203 |
| 2001/0026717 | A1 * | 10/2001 | Kobaru et al. | 399/333 |
| 2004/0146325 | A1 * | 7/2004 | Tani et al. | 399/329 |

FOREIGN PATENT DOCUMENTS

| | | | |
|---|---|---|---|
| JP | H05-019654 | A | 1/1993 |
| JP | H06-043782 | A | 2/1994 |
| JP | H06-194979 | A | 7/1994 |
| JP | H06-318000 | | 11/1994 |
| JP | H08-202181 | A | 8/1996 |
| JP | 08-328412 | | 12/1999 |
| JP | 2000-122467 | A | 4/2000 |
| JP | 2000-338803 | A | 12/2000 |
| JP | 2001-042672 | | 2/2001 |
| JP | 2002-131937 | A | 5/2002 |
| JP | 2002-189338 | A | 7/2002 |
| JP | 2002-240347 | A | 8/2002 |
| JP | 2002-251111 | A | 9/2002 |
| JP | 2002-252113 | A | 9/2002 |

(Continued)

OTHER PUBLICATIONS

Abstract of "Cooling systems based on Peltier elements and heat pipes for space application"□□Publication Date: Jul. 1980□□Authors: Best et al.*

(Continued)

*Primary Examiner*—David M. Gray
*Assistant Examiner*—Ryan D Walsh
(74) *Attorney, Agent, or Firm*—Harness, Dickey & Pierce

(57) ABSTRACT

In an image forming apparatus, a recording medium with a toner image is heated in a heat fusion region to fix the toner image on the recording medium. The image forming apparatus includes a heat pump. The heat pump includes a heat absorbing unit that absorbs heat from the recording medium and/or the toner image in a region that is different from the heat fusion region; and a heat radiating unit that release the heat, which is absorbed by the heat absorbing unit, to heat a recording medium with a toner image in the heat fusion region. Thus, the heat can be reused.

22 Claims, 5 Drawing Sheets

FOREIGN PATENT DOCUMENTS

| | | | |
|---|---|---|---|
| JP | 2002-287505 | A | 10/2002 |
| JP | 2002-323786 | A | 11/2002 |
| JP | 2003-043783 | A | 2/2003 |
| JP | 2003-162178 | A | 6/2003 |
| JP | 2004-163799 | A | 6/2004 |

OTHER PUBLICATIONS

Office Action for corresponding Japanese patent application No. 2004-079532 dated Sep. 26, 2008.

* cited by examiner

HEAT RECYCLING IMAGE FORMING APPARATUS

PRIORITY STATEMENT

This application claims priority upon Japanese Patent Application No. 2004-079532, filed on Mar. 19, 2004, the disclosure of which is incorporated herein in its entirety by reference.

BACKGROUND OF THE PRESENT INVENTION

There is a global demand to reduce energy consumption of image forming apparatuses. Some conventional image forming apparatuses have been designed to reuse the heat that is generated during the image formation.

Specifically, Japanese Patent Application Laid-Open No. H05-19654 and Japanese Patent Application Laid-Open No. 2000-338803 disclose image forming apparatuses that use a heat pipe to reuse the heat generated during the image formation for image fixation. These image forming apparatuses include a heat sink, which is positioned downstream of the section where the recording medium is heated to a melting point of toner to fuse toner images onto the recording medium. Moreover, a radiator is positioned upstream of the section where the heat fusion is performed.

These apparatuses have been designed so that the heat sink of the heat pipe absorbs the heat from the recording medium that has passed through the heat fusion section, and the radiator of the heat pipe releases the absorbed heat onto another recording medium as the another recording medium passes through the heat fusion section. This design allows thermal energy obtained from both the toner image fixing operation and the post-fixed recording medium to be transferred onto the recording medium prior to fixing of toner images. By absorbing the heat from the toner fixated images and the recording medium after passing through the heat fusion section, incidence of an offset (smearing) on the recording medium can be reduced if not prevented. On the other hand, preliminary heating of the unfixed toner images and the recording medium by the radiator before reaching the heat fusion section reduces heat energy required for fusing the toner images in the heat fusion section. Thus, the reuse of heat for the image fixing process for preliminary heating reduces the energy consumption.

However, the heat pipe in the conventional technology was originally designed to ensure efficient heat transfer from the heat sink to the radiator using elements that have extremely high thermal-conductivity. Moreover, heat transfer by thermal conduction causes heat to be transferred from a higher-temperature location toward a lower-temperature location, but not from the lower-temperature location to the higher-temperature location. Accordingly, when the heat pipe is used, the temperature of the heat sink can not rise higher than the temperature of the radiator. Moreover, the temperature of the heat fusion section increases to its upper limit during the toner fixation process, reaching a higher temperature than that of the heat sink of the heat pipe. As such, the radiator cannot be positioned in the heat fusion section, because the heat fusion section has a temperature that is higher than that of the heat sink. Therefore, the reuse of waste heat by the heat pipe for the toner fixing operation can be applied only to the preheating operation, in which the temperature of the recording medium with unfixed toner images is raised to a particular level; but not to the heating operation that occurs in the heat fusion section.

The typically close proximity of the preheating unit (radiator) and the heat fusion section causes heat to be transferred from the heat fusion section to the radiator by air conduction, raising the temperature of the radiator. As the temperature of the radiator rises and a temperature differential between the radiator and the heat sink becomes smaller, heat cannot be transferred from the heat sink to the radiator. On the other hand, if the radiator is positioned away from the heat fusion section, to avoid convection heating by the heat fusion section, then there is less efficient reuse of heat since the recording medium releases heat between the radiator and the heat fusion section.

Japanese Patent Application Laid-Open Publication No. 2001-42672 discloses an image forming apparatus that use Peltier elements to cool the surfaces of a conveying belt and a recording medium on a conveying belt downstream of the heat fusion region. In this conventional image forming apparatus, the heating member is positioned upstream from the heat fusion region in order to come into contact with the conveying belt. It is possible for this image forming apparatus to preheat the conveying belt by heat from the heating member. However, this heating member uses fans, heat sinks, and the like which release large amounts of heat into the air; and is an inefficient use of heat even when used as an auxiliary heating unit.

SUMMARY

At least one embodiment of the present invention can solve at least one of the problems described above regarding the conventional technology.

In an image forming apparatus according to an embodiment of the present invention, a recording medium with a toner image is heated in a heat fusion region to fix the toner image on the recording medium. The image forming apparatus includes a heat pump that includes a heat absorbing unit that absorbs heat from one or both of the recording medium and the toner image in a region that is different from the heat fusion region; and a heat radiating unit that release the heat, which is absorbed by the heat absorbing unit, to heat a recording medium with a toner image in the heat fusion region.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

Example embodiments of the present invention will be described below with reference to the accompanying drawings. Other embodiments not explicitly called out below, for brevity, nonetheless are contemplated. Included in the following text is a description of a powder-toner image developing electro-photographic copier (hereinafter, "copier"), according to an embodiment of the present invention. Such a copier can be described as a type of image forming apparatus.

Figure 1:
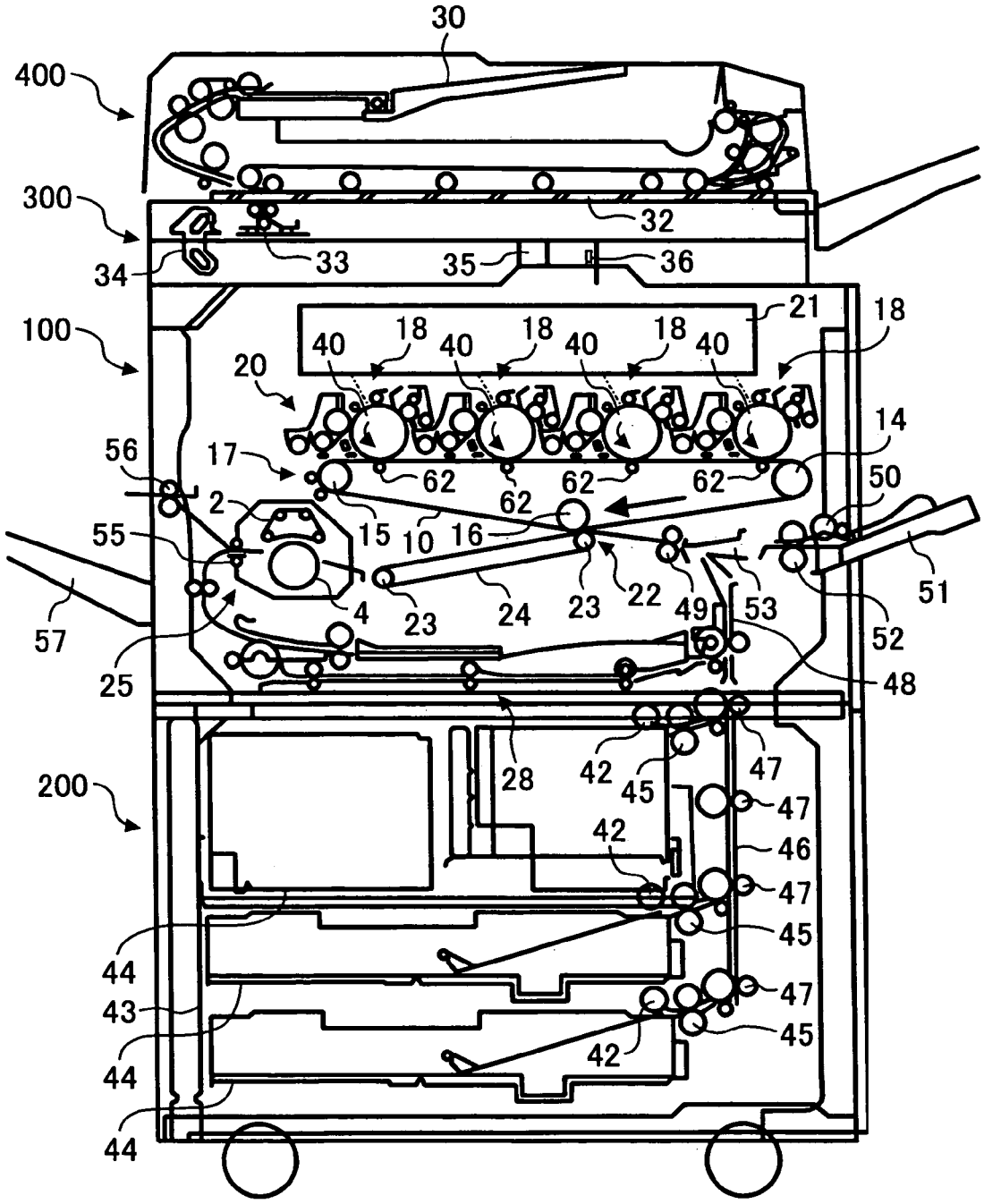
FIG. 1 is a block diagram of an image forming apparatus according to an embodiment of the present invention.

FIG. 1 is a block diagram of a copier, according to an embodiment of the present invention. The copier has a main body that includes a printer section 100, a sheet feeding unit 200, an image scanning unit 300, and a document conveying unit 400. The image scanning unit 300 is located above the printer section 100. The document conveying unit 400 includes an automatic document feeder (ADF) is located above the image scanning unit 300. Moreover, the copier includes a control unit (not shown) that controls the operations of various units of the copier.

The image scanning unit 300 includes an image reading sensor 36 to read image information from documents positioned on an exposure glass 32 and send the read image information to the control unit. Based on the image information that is received from the image scanning unit 300, the control unit controls a laser, an LED and the like (not shown) positioned in an irradiating device 21 that irradiates a writing laser beam L onto photosensitive drums 40Bk, 40Y, 40M, and 40C. Through this irradiation, latent electrostatic images are formed on the surfaces of the photosensitive drums 40Bk, 40Y, 40M, and 40C and the latent images are developed into respective toner images through an image developing process.

In addition to the irradiating device 21, the printer section 100 has a primary image transferring device 62, a secondary image transferring device 22, a toner image fixing device 25, a sheet discharging device, and a toner feeder (not shown).

The sheet feeding unit 200 has media bank 43 into which a plurality of sheet feeding cassettes 44 are inserted; a plurality of sheet feeding rollers 42 that extract sheets of a recording medium P (e.g., paper) from any one of the sheet feeding cassettes 44; a plurality of sheet separating rollers 45 that separate the sheets of the recording media P and feed each sheet sequentially to a sheet feeding path 46. Sheet conveying rollers 47 feed the recording media P to a sheet feeding path 48 of the printer section 100. In addition to the sheet feeding unit 200, manual sheet feeding is possible using a manual sheet feeding tray 51, that is located on the side of the image forming apparatus, into which the recording Media P separated sheet-by-sheet by a sheet separating roller 52. A resist roller 49 discharges, e.g., the recording media P one sheet at a time, from any one of the sheet feeding cassettes 44 or the manual sheet feeding tray 51, and sends the recording media P to a secondary image transferring nip positioned between an intermediate image transferring belt 10 that is an intermediate image transferring member, and the secondary image transferring device 22.

When taking copies of color documents, the color document is set on a document stand 30 of the document conveying unit 400, or the document conveying unit 400 is opened and the document is set on the exposure glass 32 of the image scanning unit 300. Then, upon operating a START key (not shown), the document that is set at the document conveying unit 400 is conveyed onto the exposure glass 32, and the image scanning unit 300 is activated. If, on the other hand, a document is manually placed on the exposure glass 32 and the START key is operated, the image scanning unit 300 is activated immediately to move a primary scanning member 33 and a secondary scanning member 34.

Light is emitted from a light source at the primary scanning member 33, light reflects off the surface of the document, and is further reflected towards the secondary scanning member 34. A mirror at the secondary scanning member 34 reflects the light through an imaging lens 35 onto an image reading sensor 36 that reads the image information.

Upon receiving image information from the scanner units, the image forming apparatus performs laser-writing, or implements the developing process by forming toner images on the photosensitive drums 40. The image forming apparatus then operates one of the resist rollers 49 to feed the recording media P of a size appropriate for the image information.

Concurrently, a driving motor (not shown) rotates one of a plurality of supporting rollers 14, 15, and 16; and the other two supporting rollers can be subordinately driven to rotate the intermediate image transferring belt 10. At the same time, each of the individual image forming units 18 act in unison to rotate the photosensitive drum 40, and form each single-color image of black, yellow, magenta, and cyan on the photosensitive drum 40. As the intermediate image transferring belt 10 is moved, each of the single-color images is sequentially transferred and a composite color image is formed on the intermediate image transferring belt 10.

One of the sheet feeding rollers 42 of the sheet feeding unit 200 is selectively rotated, and recording media P from one of the sheet feeding cassettes 44 is extracted and fed one-by-one, by the sheet separating roller 45, to the sheet feeding path 46. Each sheet of recording media P is guided on the sheet feeding path 45 within the printer section 100 by sheet conveying rollers 47, and stops moving upon hitting the resist roller 49. Or, the sheet feeding roller 50 rotates to extract recording media P from the manual sheet feeding tray 51, the sheet separating roller 52 separates recording media P one-by-one into the sheet feeding path 53, and the flow of manually fed recording sheet is stopped by hitting against the resist roller 49.

Then, the resist roller 49 rotates to align with the composite color image on the intermediate image transferring belt 10, and recording media P is fed into the secondary image transferring nip, which is a member formed by the contact of the intermediate image transferring belt 10 and the secondary image transferring rollers 23. The composite color image is transferred onto the recording media P by the effects of an electrical field for image transfer and contact pressure in the nip.

The recording media P, upon which the composite color image has been transferred, is then sent to a toner image fixing device 25 by a sheet conveying belt 24 of the secondary image fixing device 25; and after fixing the toner image by an application of pressure and heat through the pressure roller 4 at the toner image fixing device 25, the recording media P is and discharged by an discharging roller 56 onto a discharge tray 57.

Figure 2:
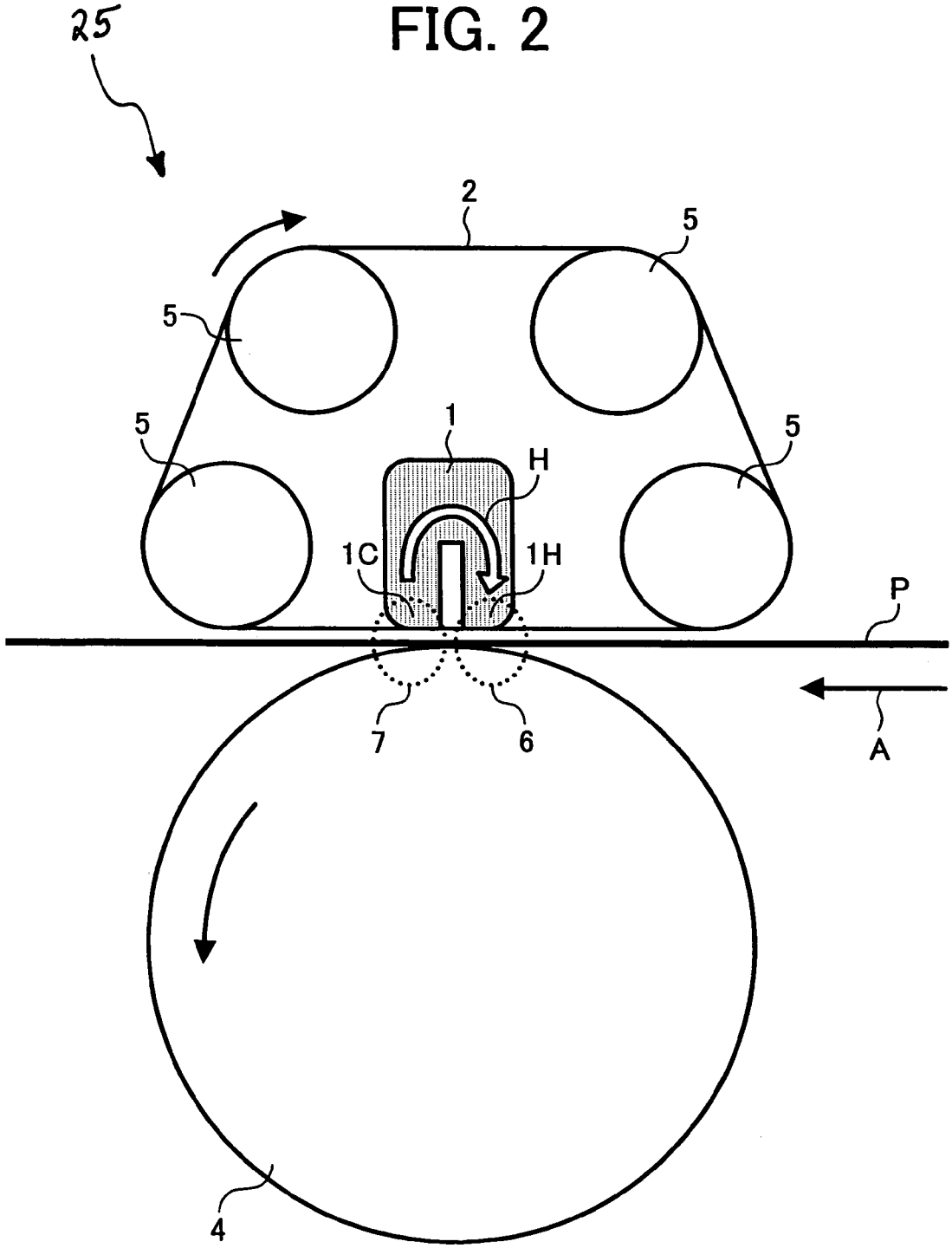
FIG. 2 is a schematic of an image forming device, according to an embodiment of the present invention.

FIG. 2 is a schematic of the toner image fixing device 25, according to an embodiment of the present invention. The toner image fixing device 25 includes a toner image fixing belt 2 that is made of a heat-resistant material; and this toner image fixing belt 2 is supported by four supporting rollers 5. Inside this toner image fixing belt 2, there is a heat pump 1 that includes a heating member 1H that heats the recording media P, and a heat sink 1C that is a cooling member; both of which come into contact with the toner image fixing belt 2.

A heat fusion region 6 is formed at a location where the heating member 1H and the toner image fixing belt 2 come into contact; and a cooling region 7 is formed at a location where the heat sink 1C and the toner fixation belt come into contact. The heat fusing region 6 and the cooling region 7 are adjacent so as to occupy substantially the same location. An arrow A indicates a direction in which the recording media P is transported; as such, the heat sink 1C can be described as being located downstream from the heating member 1H. An arrow H in the heat pump 1 indicates a direction in which heat is transferred inside the heat pump. The pressure roller 4 presses against the toner image fixing belt 2, which is sandwiched between the pressure roller 4 and the heating member 1H and the heat sink 1C of the heat pump 1.

When a recording media P that carries an unfixed toner image enters the toner image fixing device 25, the recording media P is pressed between the heating member 1H and the pressure roller 4 in the heat fusion region 6; then heat is applied to the recording media P by the heating member 1H so that the toner image fuses on the recording media P. After passing through the heat fusion region 6, the recording media P is pressed and conveyed to the cooling region 7 by the toner image fixing belt 2 and the pressure roller 4. The recording media P carrying fused toner is pressed between the heat sink 1C and the pressure roller 4; then some heat is absorbed from the recording media P by the heat sink 1C to cure and fix the toner images on the recording media P. The heat absorbed by the heat sink 1C is transferred to heating member 1H, where the heat is reused.

In FIG. 2, the heating member 1H and the heat sink 1C adjacent to each other to form a single nip above the pressure roller 4.

The heat pump 1 will now be described in more detail. The heat pump 1 transfers heat from the lower temperature heat sink 1C to a higher temperature heating member 1H. The heat pump 1 transfers heat just as a water pump moves water from a lower place to a higher place.

A heat pump is a more energy-efficient heating unit than, e.g., a conventional electrical resistance heater. And, when the heat sink has a lower temperature than the heating member, and especially when the temperature differential between the heat sink and the heating member is small, the efficiency of heat transfer becomes higher. While toner image fixing operations are being performed steadily, the heat sink 1C can maintain higher efficiency, compared with places other than the toner image fixing device 25, because large amounts of heat flow from the toner images and recording medium P to the heat sink 1C of the heat pump 1.

On the topic of heat differentials, in the toner image fixing device 25 of FIG. 2, there can be a circumstance in which there is substantially no difference (if not none at all) between the temperature of the heat sink, which has a small amount of heat, and the temperature of the area outside the heat sink when the toner image fixing device 25 starts up. It is therefore difficult to raise the temperature to the level required for toner image fixing even if there is heat transfer to the heating member. In this situation, an auxiliary heating unit (not shown) can be provided. The auxiliary heating unit can be positioned at the heat sink side or the heating member side, or both sides; but a quicker response can be expected if the auxiliary heating unit is placed at the heating member side.

The types of heat pumps used for the transfer of heat in copiers include common mechanical compression type heat pumps used e.g., in household refrigerators and air conditioners; chemical types such as absorption types and adsorption types; magnetic refrigeration types, or acoustic types. There are some heat pumps that use Peltier elements. Theoretically, any heat pump can be used in an image forming apparatus. But among these heat pumps, Peltier elements can be advantageous due to their suitability for miniaturization and on-demand operation.

Figure 3A:
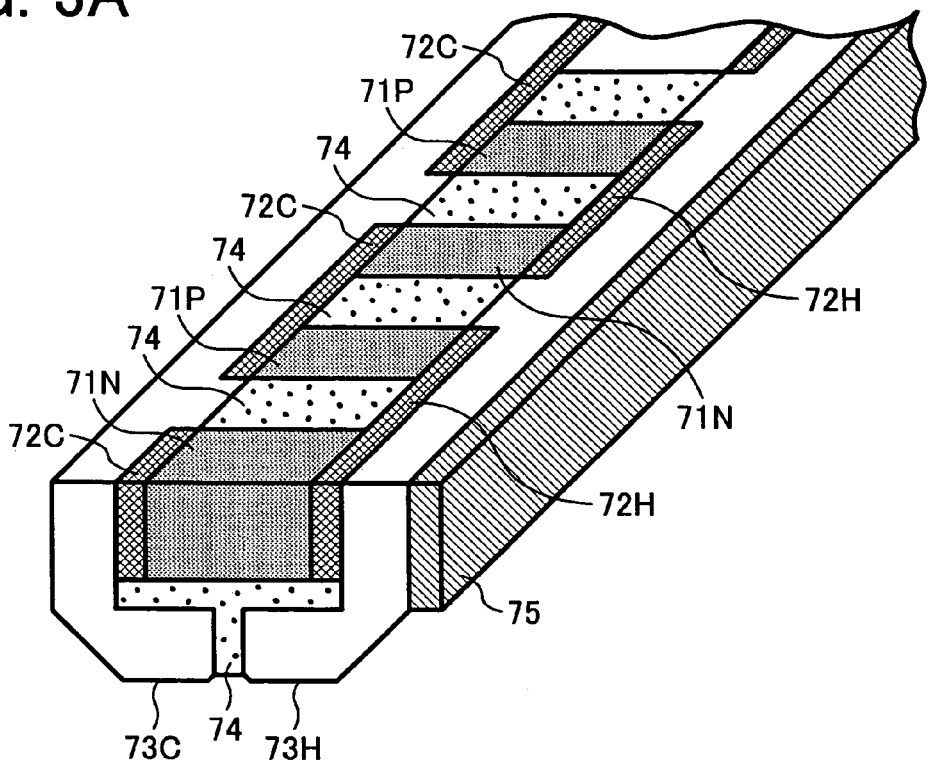
FIG. 3A is a transverse sectional view of a first example of a heat pump, according to an embodiment of the present invention.
Figure 3B:
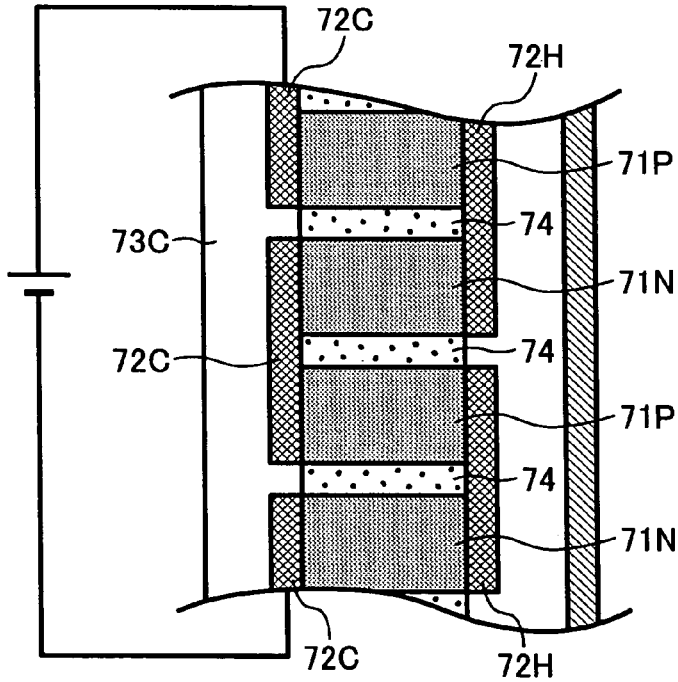
FIG. 3B is a top view of the first example of a heat pump.

FIG. 3A is a transverse sectional view of a first example of a heat pump that uses Peltier elements, according to an embodiment of the present invention. FIG. 3B is a schematic of a top view of the heat pump shown in FIG. 3A.

In FIG. 3A and FIG. 3B, the Peltier element is configured from semiconductors 71 and junctions 72. There are two types of semiconductors 71: N-type semiconductors 71N and P-type semiconductors 71P. As illustrated in FIG. 3B, the two types of semiconductors are arranged in an alternating pattern, with an insulating member 74 sandwiched between each semiconductor 71. An electrical current flows serially through the semiconductors 71 via junctions 72 on the heat sink side (hereinafter "heat sink junctions 72C") and junctions 72 on the heating member side (hereinafter "heating member junctions 72H").

Bismuth-tellurium, for example, can be used as the semiconductor material of the semiconductors 71. Alloys, e.g., zinc-antimony or sodium-cobalt oxide, can also be used as a semiconductor material that can operate at higher temperatures than bismuth-tellurium. The junctions 72 can be sheets of a metal having high electrical conductivity, e.g., copper, aluminum and the like. A difference between the heat sink junctions 72C and the heating member junctions 72H is the direction of electrical current is reversed.

As illustrated in FIG. 3A, by applying the electrical current, a heat-conducting member 73 becomes the heating member 73H, and a heat-conducting member 73 becomes the heat sink 73C. In other words, when the electrical current flows from the P-type semiconductor 71P to the metallic sheet (heating member junction 72H), and then from the metallic sheet (heating member junction 72H) to the N-type semiconductor 71N, the heating member junction 72H causes the heating member 73H to radiate heat. On the other hand, when electrical current flows from the N-type semiconductor 71N to the metallic sheet (heat sink junction 72C), and then from the metallic sheet (heat sink junction 72C) to the P-type semiconductor 71P, the heat sink junction 72C causes the heat sink 73C to absorb heat.

The heat-conducting members (heat sink 73C and heating member 73H) are positioned adjacent to the junctions (heat sink junction 72C and heating member junction 72H) of the Peltier elements (N-type semiconductors 71N and P-type semiconductors 71P). The heating member 73H guides the heat absorbed by the Peltier element 71P into the heat fusion region 6; while the heat sink 73C guides the heat from the cooling region 7 into the Peltier element 71N. The heat-conducting materials have high heat conductivity; and, unlike the heat pump, transfers heat passively. As high-conductivity materials, not only copper, aluminum, and the like, but also, e.g., ceramics with high heat conductivity may be used. Alternatively, a heat pipe may be embedded into the heat conducting members.

When using a metallic heat conducting material for the heat conducting members, consideration should be given to an electrical insulating material that is positioned between the heat conducting members and the junctions, so as to avoid any contact with the junction that could result in a short circuit. The insulating member 74 is positioned between the heat sink 73C and the heating member 73H, and between the semiconductors 71N and 71P to deter a short circuit between the N-type semiconductor 71N and the P-type semiconductor 71P. Furthermore, the insulating member 74 also insulates against heat transfer to reduce heat conduction between the heating member and heat sink.

The heating member 73H can be equipped with an auxiliary heater 75 that is activated when sufficient heat cannot be absorbed at the heat sink due to a low temperature, for example, the low temperature when the toner fixation device has just been activated. Electrical resistance heaters, e.g., ceramic heaters and the like, are suitable for the auxiliary heater 75.

At the heating member junction 72H of the Peltier element, Joule heat is added to the heat conducted from the heat sink junction 72C to reach a temperature (about 200-300 degrees centigrade) at which toner images can be fixed. Some commercially available Peltier elements have an upper temperature limit at the heating member junction of about 80 degrees centigrade because the Peltier elements are joined with a reflow-solder that has a low fusing temperature. But some materials that can be used for the semiconductors 71N and 71P can reach a temperature of about 150 to 200 degrees centigrade, (e.g., bismuth-tellurium materials), and others over 200 degrees centigrade (e.g., zinc-antimony materials, sodium-cobalt materials, etc.)

The configuration of the heat pump 1 using Peltier elements is not limited to the configurations illustrated in both FIG. 3A (transverse sectional view) and FIG. 3B (top view). Any heat pump configuration may be used provided that heat is absorbed and released using the Peltier effect.

Figure 4:
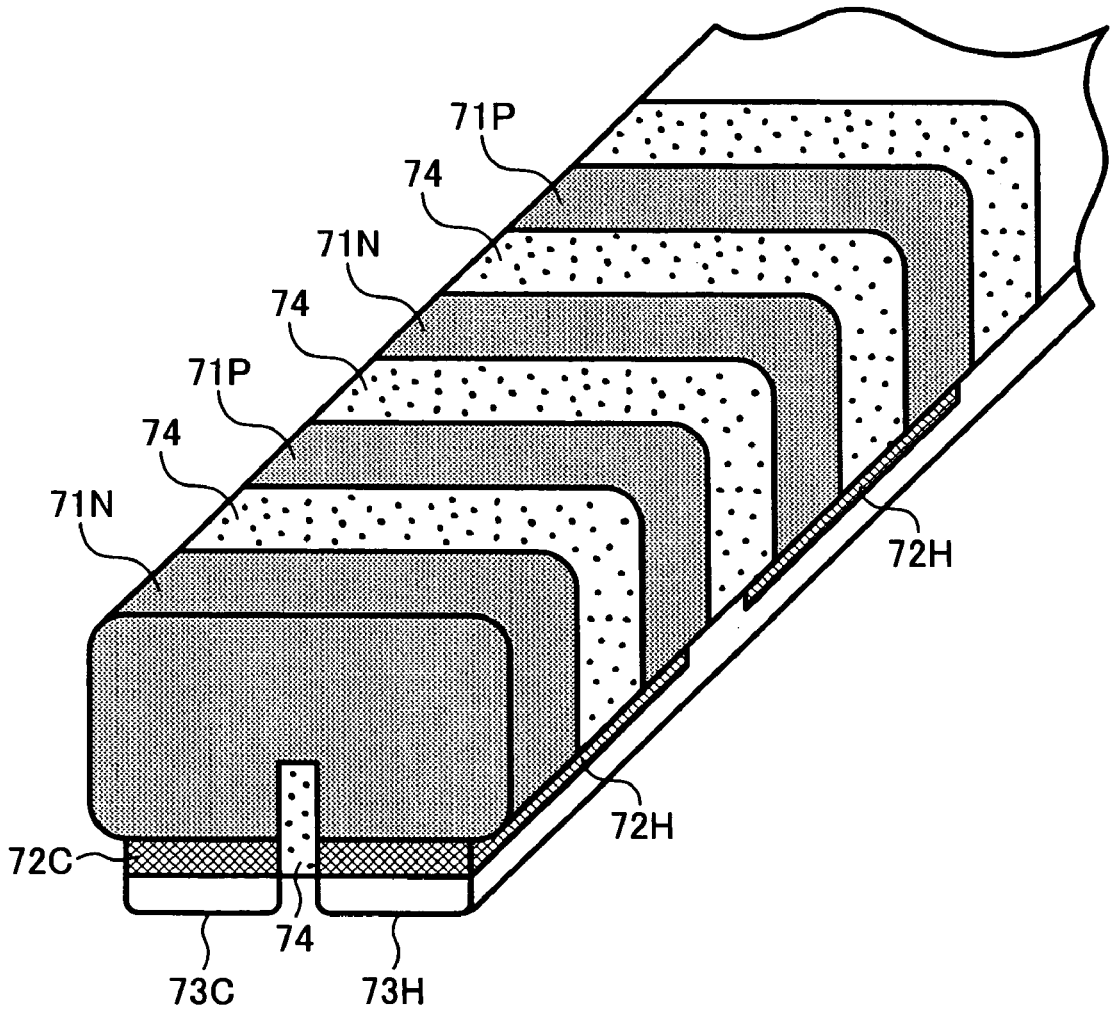
FIG. 4 is a transverse sectional view of a second example of a heat pump, according to an embodiment of the present invention.

FIG. 4 is a transverse sectional view of a second example of a heat pump, according to an embodiment of the present invention. In FIG. 3A and FIG. 3B the semiconductors 71N and 71P and the insulating members 74 have a rectangular block shape, but in FIG. 4 the semiconductors 71N and 71P and the insulating members 74 have a shape resembling the letter "n". The relative positions and roles of each component in FIG. 4 are the same as FIG. 3A and FIG. 3B, so an explanation is omitted. In FIG. 4, the heating member junction 72H and the heat sink junction 72C are attached at the feet of the n-shaped semiconductors 71N and 71P and the insulating members 74.

Comparing FIGS. 3A and 3B with FIG. 4, instead of placing the heat conducting elements 73C and 73H on both sides of the row of semiconductors 71N and 71P and insulating members 74, the heat conducting elements 73C and 73H are placed underneath the feet of the n-shaped semiconductors 71N and 71P and insulating members 74, reduces the cubic volume needed for the heat conducting members 73C and 73H.

A decrease in cubic volume of the heat conducting members 73C and 73H reduces heat capacity of the heat conducting members 73C and 73H which reduces a start-up time of the heat pump 1. But since a purpose of the heat conducting members 73C and 73H can be to homogenize the temperature at the heat fusion region 6 and the cooling region 7, consideration should be given against making the heat conducting members 73C and 73H extremely small if this purpose is to be adequately served. Where the heat conducting members 73C and 73H in FIG. 4 are not made extremely small, they nevertheless can be made, e.g., smaller than the heat conducting members 73C and 73H of FIGS. 3A and 3B.

The transfer of heat using Peltier elements is not limited to a single row, as in the heat pumps of FIG. 3A, FIG. 3B, and FIG. 4; and it is acceptable to position multiple rows of Peltier elements that are configured to incrementally move heat from the heat sink to the heating member. In this multiple row configuration, heat conducting members made, e.g., of copper, aluminum and the like, are positioned between Peltier elements the multiple rows. Compared to single row heat transfer, multiple row heat transfer can transfer heat between a heat sink and a heating member that has a relatively larger temperature differential. Furthermore, reducing the temperature differential in front of and behind the first row of Peltier elements reduces the danger of damage to the Peltier elements and surrounding members due to thermal stress.

Thus, an image forming apparatus can use the heat pump 1 as the heat exchange unit to reuse the heat generated during the toner image fixing process, and can use the heating member 1H is used as the heating unit in the heat fusion region 6 of the toner image fixing device 25. The use of the heating member 1H can achieve, compared with a configuration to perform auxiliary heating, a reduction in the amount of heat dissipated during heat transfer that accompanies the movement of the recording medium P. This reuse of waste heat and reduction of heat dissipation can achieve a reduction of electrical power required for tone image fixing that can make greater energy conservation possible.

The use of the heat sink 1C of the heat pump 1 to cool the heated recording medium P can more effectively use the waste heat generated during the toner image fixing operation and, unlike a copier that uses a heat pipe, can more effectively reduce (if not minimize) deterioration in cooling efficiency when the copier is continuously used. Such reduced deterioration in cooling efficiency can help to reduce the chances of (if not prevent) an occurrence of an offset (smearing) of a toner image caused by insufficient cooling.

Furthermore, the heat pump 1 can use the Peltier elements, which can achieve a size of the heat pump 1 that is smaller than the other types of heat pumps. Moreover, the heat pump 1 using the Peltier elements can have faster heat control response compared with other types of heat pumps, so the heating temperature can be precisely controlled.

The auxiliary heater 75 positioned adjacent to the heat pump 1 can compensate for insufficient heat supply at start-up, and can help to ensure a more stable toner image fixing operation.

Furthermore, in a configuration in which the heating member 1H and the heat sink 1C have been positioned adjacent to each other to form a single nip on the pressure rollers 4, the amount of heat dissipated from the recording medium P and the toner image on the recording medium P can be reduced on the path from the heat fusion region 6 to the cooling region 7. This configuration can increase the heat entering the heat sink 1C of the heat pump 1 and can improve heat exchange efficiency, and can reduce the amount of heat dissipated from the surface of the recording medium P compared with the configuration in which the heating member 1H and the heat sink 1C have not been positioned adjacent to each other.

The preceding discussion has assumed an image forming apparatus that uses powder-toner image developing, but the present invention is not limited only to such image developing. For example, an embodiment of the present invention can be an image forming apparatus using liquid-toner image developing, where the liquid-toner is fixed by heating.

Figure 5:
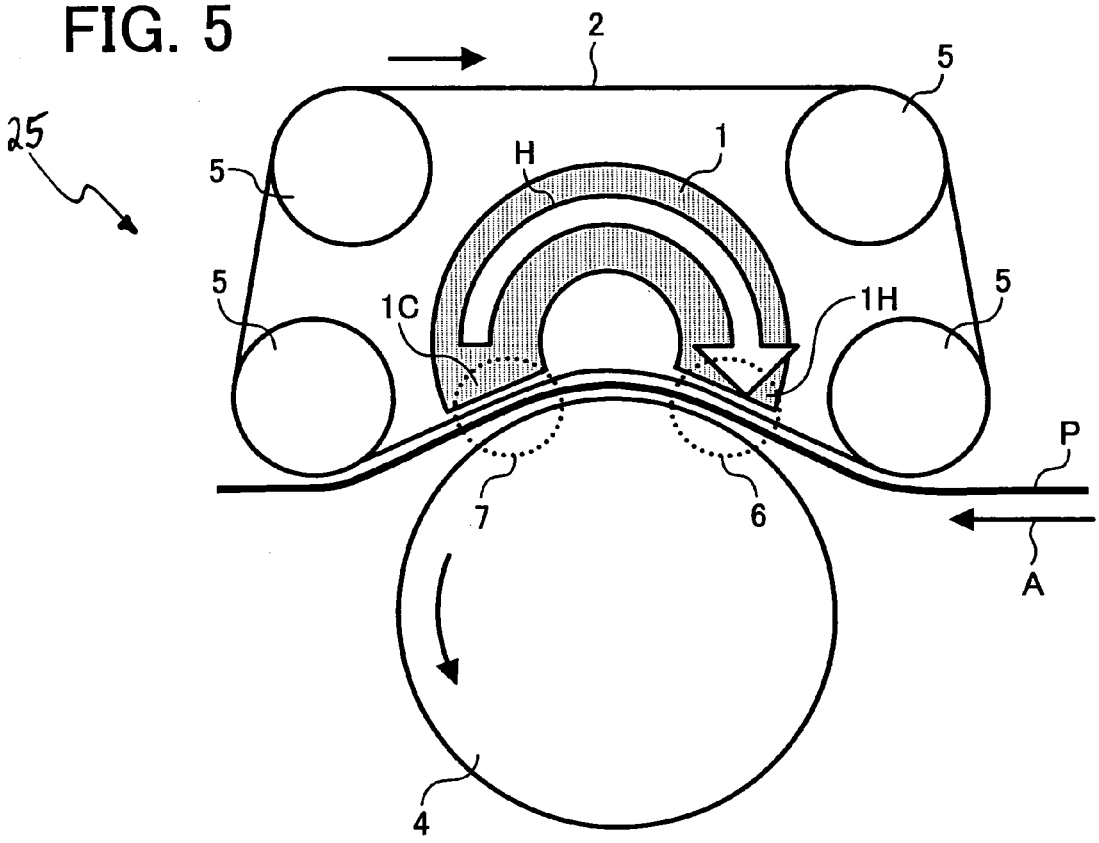
FIG. 5 is a schematic of an image forming device, according to an embodiment of the present invention.

FIG. 5 illustrates an image forming device according to an embodiment of the present invention. In FIG. 5, the heating member 1H and the heat sink 1C have been positioned apart from each other, and the pressure roller 4 is pressing the toner image fixing belt 2 against the heating member 1H and the heat sink 1C at the two locations. The toner image fixing device 25 in FIG. 5 has the same configuration as the toner image fixing device 25 in FIG. 2, except that the pressure roller 4 and the heat pump 1 are pressed against each other at two points, so the descriptions of the individual members are omitted.

In the toner image fixing device 25 illustrated in FIG. 5, since the heating member 1H and the heat sink 1C are positioned apart from each other so that the pressure roller 4 and the heat pump 1 press against each other at two locations it is possible to gain a wider space between the heat fusion region 6 and the cooling region 7. If the pressure members (e.g., the four supporting rollers 5) have the roller shape illustrated in FIG. 5, then a wider nip space can be achieved between the toner image fixing belt 2 and the pressure roller 4. Thus, the wider nip space can help to achieve a more stable toner image fixing operation.

Figure 6:
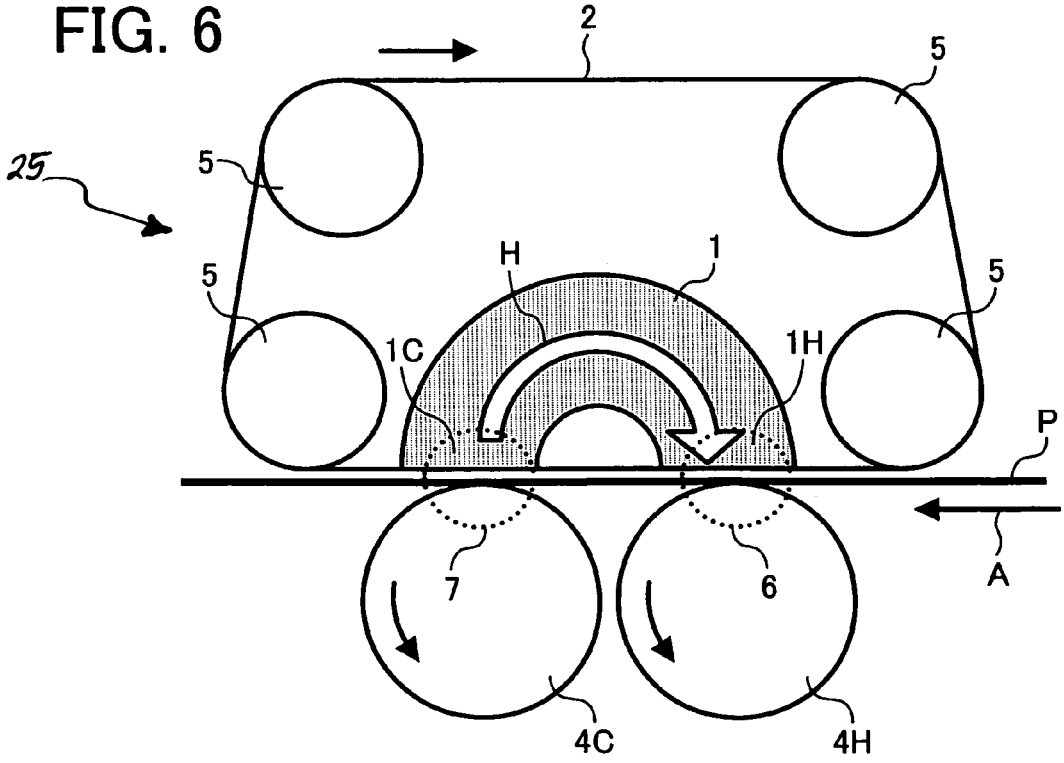
FIG. 6 is a schematic of an image forming device, according to an embodiment of the present invention.

Next, FIG. 6 illustrates an image forming device according to an embodiment of the present invention. In FIG. 6, two different pressure rollers, namely a heat sink pressure roller 4C and a heating member pressure roller 4H, press against the toner image fixing belt 2 which, in turn, presses against the heat sink 1C and the heating member 1H. The toner image fixing device 25 illustrated in FIG. 6 has the same configuration as the toner image fixing device 25 illustrated in FIG. 3, except that the toner image fixing belt 2 is pressed against the two pressure rollers 4C and 4H to respectively form the cooling region 7 and the heat fusion region 6; so the descriptions of the individual members are omitted.

By positioning the heat sink pressure roller 4C at the cooling region 7 and the heating member pressure roller 4H at the heat fusion region 6, spacing the cooling region 7 and the heat fusion region 6 can achieve a nip space in a manner similar to the configuration in FIG. 5, albeit a nip space that is wider. Moreover, the provision of the separate pressure rollers, namely the pressure rollers 4C and 4H, facilitates the heating member pressure roller 4H being used to promote high temperature conditions and the heat sink pressure roller 4C being used to promote low temperature conditions. The configuration in which one pressure roller is maintained at a higher temperature and another pressure roller is maintained at a lower temperature can reduce energy consumption compared with the toner image fixing device 25 having the configuration in which a common pressure member is pressed against both the heating member 1H and the heat sink 1C.

It is acceptable to use a material that has relatively a higher thermal conductivity ratio for the surface of the heating member pressure roller 4H and the heat sink pressure roller 4C. The use of the material that has a higher thermal conductivity ratio on the heating member pressure roller 4H allows the heating member pressure roller 4H to be heated (via convection and/or radiant, etc., heating) by the heating member 1H during the interval after a recording medium P has passed and before the following recording medium P enters the heat fusion region 6 (or, in other words, when no recording medium P is interposed between the heating pressure roller 4H and the heating member 1H). The recording medium P is heated from both the upper and lower sides by the heating member 1H and the heating member pressure roller 4H, which can help to reduce the chance of insufficient heating of toner.

On the other hand, the use of the material that has a relatively high thermal conductivity ratio on the heat sink pressure roller 4C allows the heat sink pressure roller 4C to be cooled (via convection and/or radiant, etc., heat absorption) by the heat sink 1C during the interval when the recording medium P passes through the cooling region 7. The cooling of the heat sink pressure roller 4C permits a cooling of the next recording medium P from both the upper and lower sides. It becomes possible to more efficiently absorb heat from the recording medium P, and to reduce the amount of heat dissipated out of the toner image fixing device 25 as the recording medium P is moving. Moreover, the chances of there occurring an offset (smearing) due to insufficient cooling can be reduced if not prevented.

In FIGS. 2, 5 and 6, the heat sink 1C is positioned so as to cool the heated recording medium P, but the position of the heat sink 1C is not limited as such. Alternatively, the heat sink 1C can be positioned outside of the cooling region.

In the image forming apparatus, the places where waste heat is generated is not limited to the recording medium P having a fixed toner image. Waste heat is generated in places other than in the toner image fixing process, e.g., at a driving source and the like. Accordingly, as an example of an alternative, it is acceptable to position the heat sink 1C at a place where waste heat is generated to reuse the waste heat as toner image fixing heat.

Continuing as to the example alternative, e.g., the heat sink 1C can be placed in close proximity to a heat-generating member that is outside the toner image fixing device, and the heating member 1H can be placed in the auxiliary heating unit in order, e.g., to recycle waste heat that is generated outside of the toner image fixing device 25. Furthermore, the placement of the heat sink 1C near a heat-generating member outside the toner image fixing device 25 can help to deter a rise in temperature of surrounding members. The conventional methods of deterring such a rise in temperature include positioning the heat-generating members outside the external chassis of the image forming apparatus. The example alternative can permit members, that otherwise could not be placed near the toner image fixing device 25, to be placed near the toner image fixing device 25; which can widen the range of selectable layouts within the image forming apparatus.

It can be difficult to use the example alternative as a heating unit at the heat fusion region 6 in a circumstance in which the amount of waste heat from members outside of the toner image fixing device 25 is smaller compared with the waste heat from the recording medium P after toner image fixing. In that circumstance, it is possible to use the example alternative as an auxiliary heating unit.

One or more of the above-discussed example embodiments of the present invention can reduce heat loss more effectively than conventional toner image fixing methods that use a heat pipe. One or more of the above-identified embodiments of the present invention can reduce energy required for toner image fixing, and/or can facilitate greater energy-saving.

The present invention being thus described, it will be obvious that the same may be varied in many ways. Such variations are not to be regarded as a departure from the spirit and scope of the present invention, and all such modifications are intended to be included within the scope of the present invention.

The invention claimed is:

1. An image forming apparatus, in which heat is provided in a heat fusion region to affix a toner image to a recording medium, comprising a heat pump that includes at least the following, a heat radiating unit that transfers energy as heat at a temperature $T_w$ in the heat fusion region to heat a recording medium with a toner image thereon, and a heat absorbing unit that absorbs heat energy at a temperature $T_c$, where $T_c<T_w$, in a region that is different than the heat fusion region, from one or both of the recording medium and the toner image, the heat pump returning at least a portion of the absorbed energy from the heat absorbing unit to the heat radiating unit, and wherein the heat pump, in cross section, resembles a letter "n", and the heat pump includes a Peltier element.

2. The image forming apparatus according to claim 1, wherein the heat absorbing unit is located, with respect to a direction of movement of the recording medium, downstream relative to the heat fusion region.

3. The image forming apparatus according to claim 1, wherein the heat radiating unit and the heat absorbing unit are positioned in close proximity.

4. The image forming apparatus according to claim 1, further comprising:

a pressure member that presses the recording medium against the heat radiating unit and the heat absorbing unit.

5. The image forming apparatus according to claim 1, wherein the heat radiating unit and the heat absorbing unit are positioned with an intervening space.

6. The image forming apparatus according to claim 5, further comprising:

a first pressure member that presses the recording medium against the heat radiating unit; and a second pressure member that presses the recording medium against the heat absorbing unit.

7. The image forming apparatus according to claim 1, wherein the heat pump further comprises:

N and P-type semiconductors and junctions arranged in an alternating pattern;

an insulating member located between the semiconductors and an insulating member located between a heating member and a heat sink;

a heat sink junction located between a semiconductor and a heat sink; and a heating member junction located between a semiconductor and a heating member, the junctions configured to allow current to flow serially through the semiconductors.

8. The image forming apparatus according to claim 7, further comprising a supplemental heating unit that transfers additional energy as heat to the heating member.

9. The image forming apparatus according to claim 7, wherein the semiconductors are made of at least one of the three following materials:

a) bismuth-tellurium b) zinc-antimony c) sodium cobalt oxide.

10. The image forming apparatus according to claim 7, wherein when current flows from the P-type semiconductor through a heating member junction to an N-type semiconductor, the heating member radiates heat and when electrical current flows from the N-type semiconductor, through a heat sink junction to a P-type semiconductor, the heat sink in the heat pump will absorb heat.

11. The image forming apparatus according to claim 10, wherein the heating member and the heat sink transfer heat passively.

12. The image forming apparatus according to claim 1, further comprising a heat pipe embedded into the heating member and heat sink.

13. An image fixing device in which a recording medium with a toner image thereon is heated in a first fusion region to affix the toner image, the image fixing device comprising:

a heat pump including the following, a heating end to transfer energy as heat at a temperature $T_w$ in the first region to the recording medium with the toner image thereon, and a heat-sinking end to sink heat energy at a temperature $T_c$, where $T_c<T_w$, in a second region, different than the first region, from one or both of the recording medium and the toner image thereon, at least a portion of the absorbed energy being recycled from the heat absorbing end to the heat radiating end; and a bias assembly to bias the recording medium against the heat pump, wherein the heat pump, in cross section, resembles a letter "n", and the heat pump includes a Peltier element.

14. The image fixing device of claim 13, wherein:

the bias assembly is a roller assembly; and the heat pump is arranged with respect to the roller assembly to form a pinch therebetween into which the recording medium can be inserted.

15. The image fixing device of claim 13, wherein the first and second regions are substantially adjacent.

16. The image fixing device of claim 13, wherein one of the following is true:

the roller assembly includes one roller the circumference of which passes through both of the first and second regions; and the roller assembly includes a first roller the circumference of which passes through the first region and a second roller the circumference of which passes through the second region.

17. The image fixing device of claim 13, wherein:

the Peltier element includes alternating regions of differently doped semiconductor material; and each of the alternating regions of differently doped semiconductor material, in cross section, resembles the letter "n".

18. A heat pump for use in an image forming apparatus in which heat is provided in a heat fusion region to affix a toner image to a recording medium, the heat pump comprising:

a heat radiating end to provide energy as heat at a temperature $T_w$ in the heat fusion region to heat a recording medium with a toner image thereon; and a heat-sinking end to sink heat energy at a temperature $T_c$, where $T_c<T_w$, in a sink region that is different than the heat fusion region, from one or both of the recording medium and the toner image;

wherein at least a portion of the absorbed energy is recycled from the heat absorbing end to the heat radiating end, wherein the heat pump, in cross section, resembles a letter "n", and the heat pump includes a Peltier element.

19. The image fixing device of claim 18, wherein the heat fusion region and the sink region are substantially adjacent.

20. An image fixing device in an image forming apparatus, the device comprising:

the heat pump of claim 18; and a roller assembly;

wherein the heat pump is arranged with respect to the roller assembly to form a pinch therebetween into which a sheet of a recording medium with a toner image thereon can be inserted.

21. An image forming apparatus comprising:

the image fixing device of claim 20; and a sheet moving assembly to provide the sheet of the recording medium to, and then to receive the sheet of the recording medium from, the roller assembly.

22. An image forming apparatus, in which heat is provided in a heat fusion region to affix a toner image to a recording medium, comprising:

a fixing device including a belt type fixing member configured to heat a recording medium with a toner image thereon;

a heat pump that includes at least the following:

a heat radiating unit that heats the fixing member in the heat fusion region to heat the recording medium with a toner image thereon, and a heat absorbing unit that absorbs heat energy in a region that is different than the heat fusion region, from the fixing member, the heat pump returning at least a portion of the absorbed energy from the heat absorbing unit to the heat radiating unit, and wherein the heat pump, in cross section, includes the heat radiating unit having an end and the heat absorbing unit having an end, the heat radiating end and the heat absorbing end are located adjacent to each other and are insulated from each other by an insulating member located between the ends, the heat radiating unit and the heat absorbing unit are connected to each other and define a path for moving the absorbed energy to flow around the insulating member from the heat absorbing unit to the heat radiating unit, and the heat pump includes a Peltier element.

* * * * *